US009628901B2

(12) United States Patent
Tracy

(10) Patent No.: US 9,628,901 B2
(45) Date of Patent: Apr. 18, 2017

(54) LOUDSPEAKER SYSTEM

(71) Applicant: Dennis A. Tracy, Culver City, CA (US)

(72) Inventor: Dennis A. Tracy, Culver City, CA (US)

( * ) Notice: Subject to any disclaimer, the term of this patent is extended or adjusted under 35 U.S.C. 154(b) by 0 days.

(21) Appl. No.: 15/213,975

(22) Filed: Jul. 19, 2016

(65) Prior Publication Data

US 2016/0330543 A1 Nov. 10, 2016

Related U.S. Application Data

(63) Continuation of application No. 14/546,560, filed on Nov. 18, 2014, now Pat. No. 9,420,361.

(60) Provisional application No. 61/906,594, filed on Nov. 20, 2013.

(51) Int. Cl.
*H04R 1/28* (2006.01)
*H04R 1/02* (2006.01)

(52) U.S. Cl.
CPC ..... *H04R 1/2811* (2013.01); *H04R 1/02* (2013.01)

(58) Field of Classification Search
None
See application file for complete search history.

(56) References Cited

U.S. PATENT DOCUMENTS

| | | | |
|---|---|---|---|
| 5,146,508 | A | 9/1992 | Bader |
| 5,388,162 | A | 2/1995 | Sohn |
| 6,460,651 | B1 | 10/2002 | Sahyoun |
| 6,493,455 | B1 | 12/2002 | Tracy |
| 8,577,073 | B2 | 11/2013 | Tracy |

*Primary Examiner* — Paul Huber
(74) *Attorney, Agent, or Firm* — Welsh Flaxman & Gitler LLC

(57) ABSTRACT

A loudspeaker system includes a housing having an upper housing unit, a lower housing unit, and a cylindrical passageway connecting the upper housing unit and the lowering housing unit such that the upper housing unit and the lower housing unit are in fluid communication. A driver mounting plate is secured within the lower housing unit and divides the housing into an upper compartment and a lower compartment. At least one of the side walls of the lower housing unit includes a side wall aperture linking the lower compartment to an external environment surrounding the housing. A driver is mounted to the driver mounting plate, the driver being positioned to fire into the lower compartment of the housing.

7 Claims, 6 Drawing Sheets

LOUDSPEAKER SYSTEM

CROSS REFERENCE TO RELATED APPLICATION

This application is a continuation of U.S. patent application Ser. No. 14/546,560, entitled "Loudspeaker System," filed Nov. 18, 2014, which is currently pending, which claims the benefit of U.S. Patent Application Ser. No. 61/906,594, entitled "Loudspeaker System," filed Nov. 20, 2013.

BACKGROUND OF THE INVENTION

1. Field of the Invention

The present invention relates to a loudspeaker system. More particularly, the invention relates to a low frequency loudspeaker, that is, a subwoofer module.

2. Description of the Related Art

The current global community has made it possible for people all around the country, and around the world, to interact for both business and personal reasons. For many people, this requires they spend considerable time traveling from one location to another location. More often than not, these people travel in aircraft. Whether these people travel in private or commercial aircraft, they desire high quality entertainment during the many hours they spend within the confines of an aircraft. However, while high quality entertainment, for example, digital video with CD quality sound, is readily available for theater and home use, the weight and size requirements for use in aircraft make it very difficult to incorporate high fidelity systems within an aircraft. This problem is especially pronounced for audio loudspeaker assemblies when one attempts to meet the size, weight and shape requirements for use in aircrafts.

In the aircraft industry, great priority is placed upon component weight and size reduction. In addition, spacing and positioning of the loudspeaker assemblies are a great priority to those optimizing the operation of aircraft. The size, weight and shape of conventional terrestrial loudspeaker assembly designs adversely affect range and payload. These concerns are notable when one attempts to make changes within smaller, private jets. For example, a small increase in the weight carried by an aircraft results in a substantial increase in fuel consumption of the aircraft. In addition, the limited space available within an aircraft dictates the use of any space within the aircraft be carefully considered by those responsible for ensuring the comfort of passengers.

Lightweight and compact audio loudspeakers are currently available. These loudspeakers, however, substantially compromise sound quality for reductions in size and weight. An individual wishing to add an audio system to an aircraft must make a choice between high fidelity loudspeakers not suiting the size and weight requirements of the aircraft and lower quality loudspeakers providing desirable size and weight characteristics.

A need, therefore, exists for loudspeaker assemblies providing low frequency, high fidelity sound, while meeting the size and weight requirements of an aircraft. The present invention provides such a loudspeaker assembly.

SUMMARY OF THE INVENTION

It is, therefore, an object of the present invention to provide a loudspeaker system including a housing having an upper housing unit, a lower housing unit, and a cylindrical passageway connecting the upper housing unit and the lowering housing unit such that the upper housing unit and the lower housing unit are in fluid communication. A driver mounting plate is secured within the lower housing unit and divides the housing into an upper compartment and a lower compartment. The upper compartment is defined by an upper surface of the driver mounting plate, a portion of the lower housing unit, the cylindrical passageway and the upper housing unit. The lower compartment is defined by a lower surface of the driver mounting plate and a plurality of side walls of the lower housing unit, a bottom of the housing remaining open to be ultimately closed off when the loudspeaker system is mounted to a supporting surface. At least one of the side walls of the lower housing unit includes a side wall aperture linking the lower compartment to an external environment surrounding the housing. A driver is mounted to the driver mounting plate, the driver being positioned to fire into the lower compartment of the housing.

It is also an object of the present invention to provide a loudspeaker system wherein the driver is a low frequency driver.

It is another object of the present invention to provide a loudspeaker system wherein the housing is made of aluminum honeycomb sheet material that resonates in a manner transmitting sound from an interior of the housing.

It is a further object of the present invention to provide a loudspeaker system wherein the upper housing unit includes four side walls, and the lower housing unit includes four side walls.

It is also an object of the present invention to provide a loudspeaker system wherein each of the four side walls of the lower housing unit includes the side wall aperture.

It is another object of the present invention to provide a loudspeaker system wherein the upper housing unit includes four lateral side walls and four corner side walls, and the lower housing unit includes four lateral side walls and four corner side walls.

It is a further object of the present invention to provide a loudspeaker system wherein each of the four corner side walls of the lower housing unit includes the side wall aperture.

It is also an object of the present invention to provide a loudspeaker system wherein the housing is square shaped.

It is another object of the present invention to provide a loudspeaker system wherein the housing is octagonal shaped.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

Figure 1:
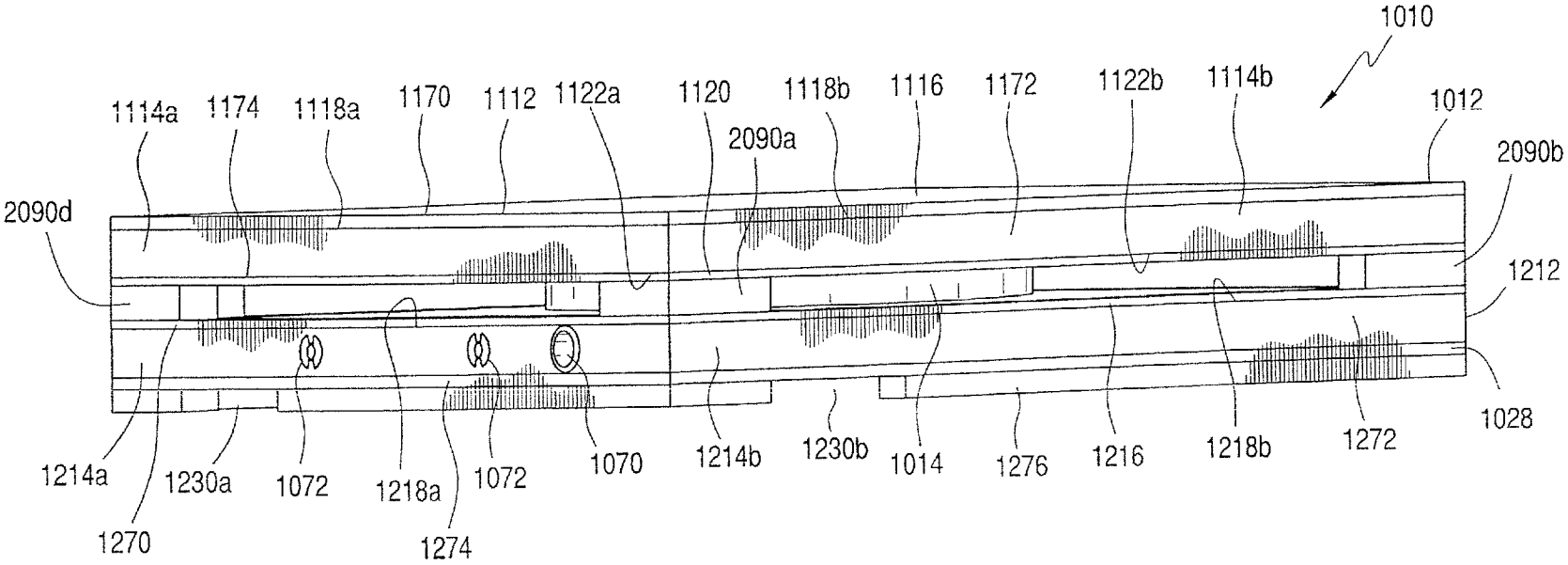
FIG. 1 is a side plan view of a subwoofer module in accordance with an alternate embodiment.
Figure 2:
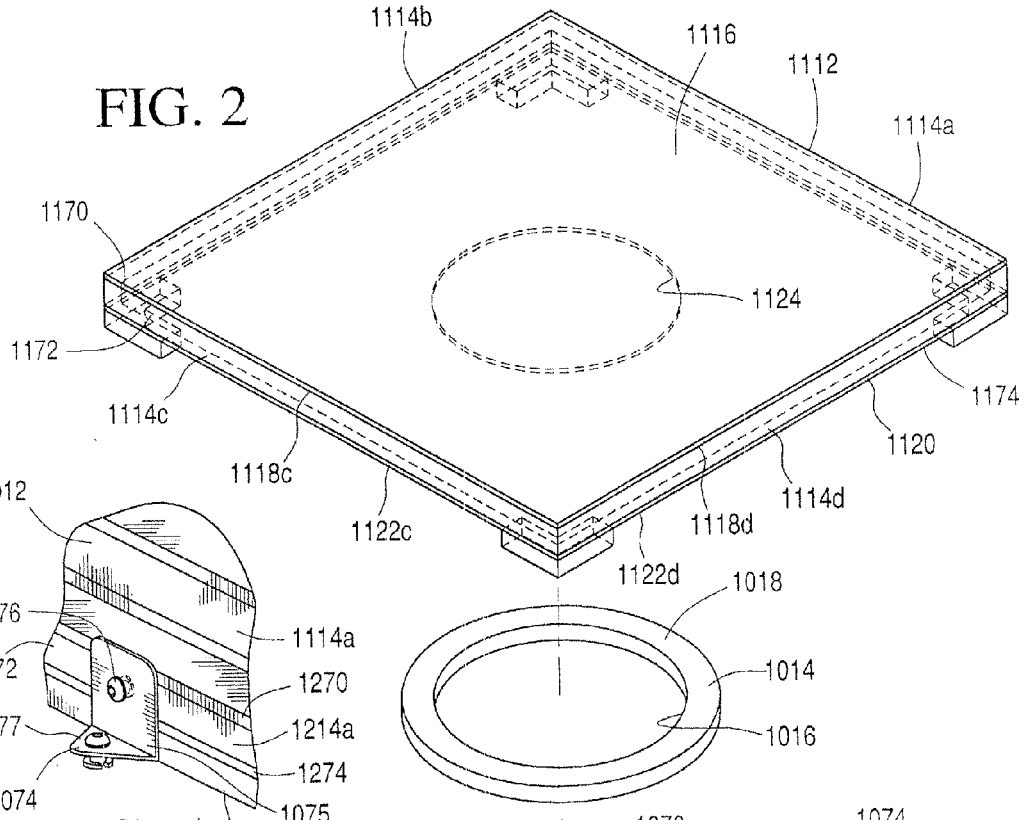
FIG. 2 is an exploded view of the housing for the subwoofer module shown in FIG. 1 (with the driver not shown).
Figure 5:
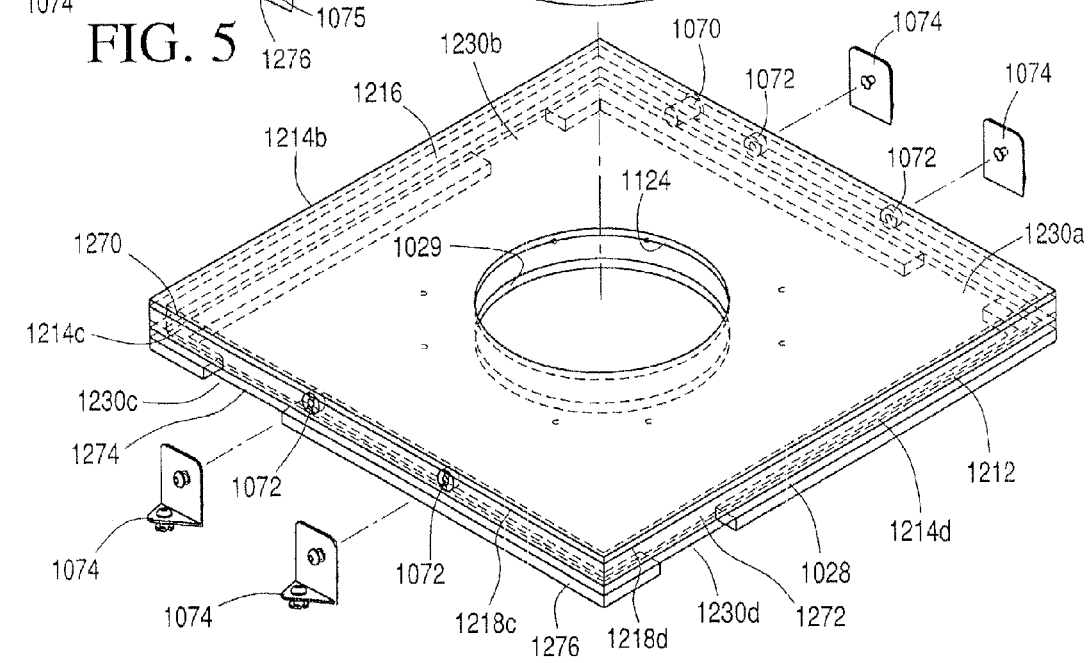
FIG. 5 is a detailed perspective view showing the mounting structure used in accordance with the subwoofer module shown in FIG. 1.
Figure 3:
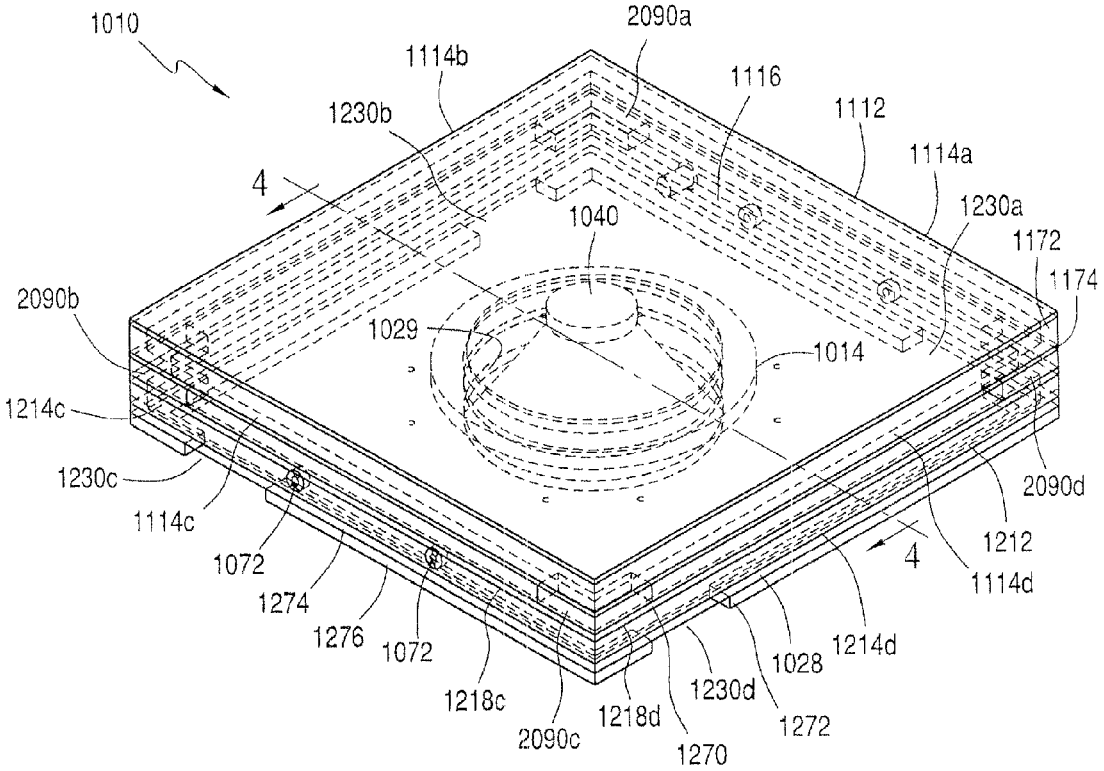
FIG. 3 is a perspective view of the subwoofer module shown in FIG. 1.
Figure 4:
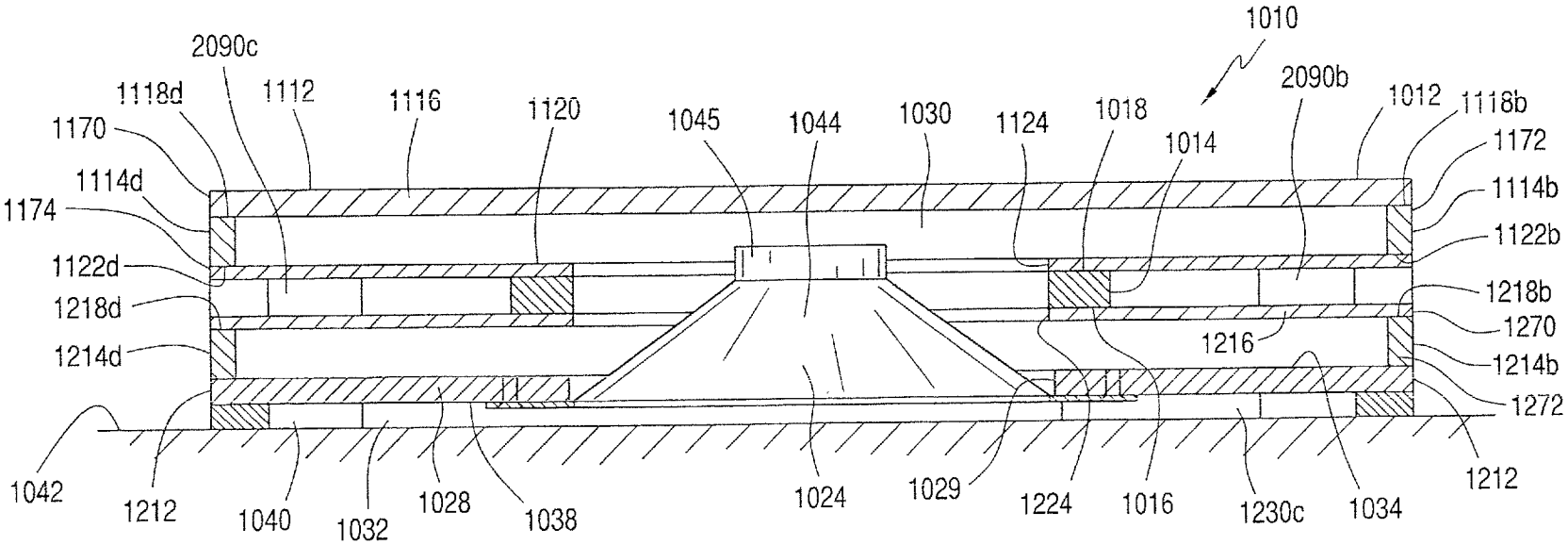
FIG. 4 is a cross sectional view along the line 4-4 of the subwoofer module shown in FIG. 1.
Figure 6:
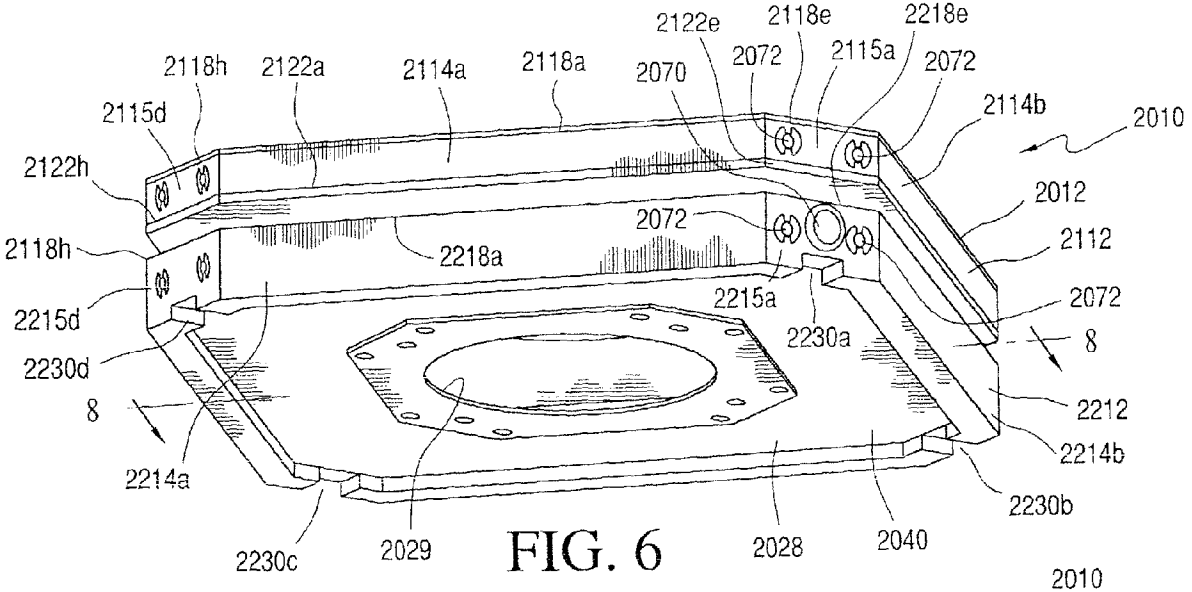
FIG. 6 is a bottom perspective view of a subwoofer module in accordance with yet another embodiment.
Figure 8:
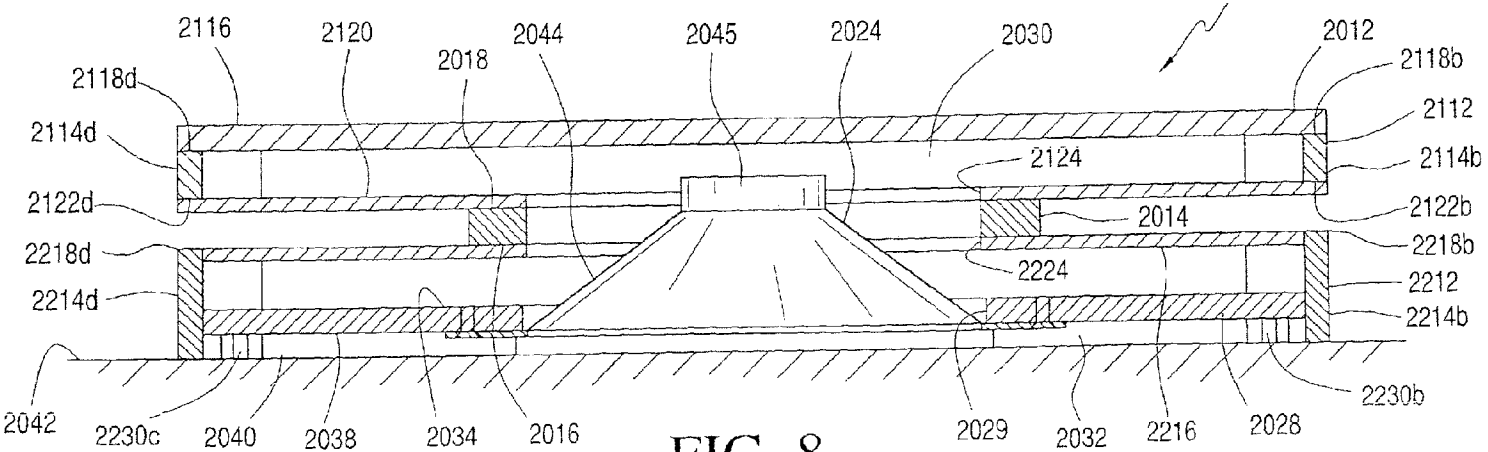
FIG. 8 is a cross sectional view along the line 7-7 of the subwoofer module shown in FIG. 6.
Figure 7:
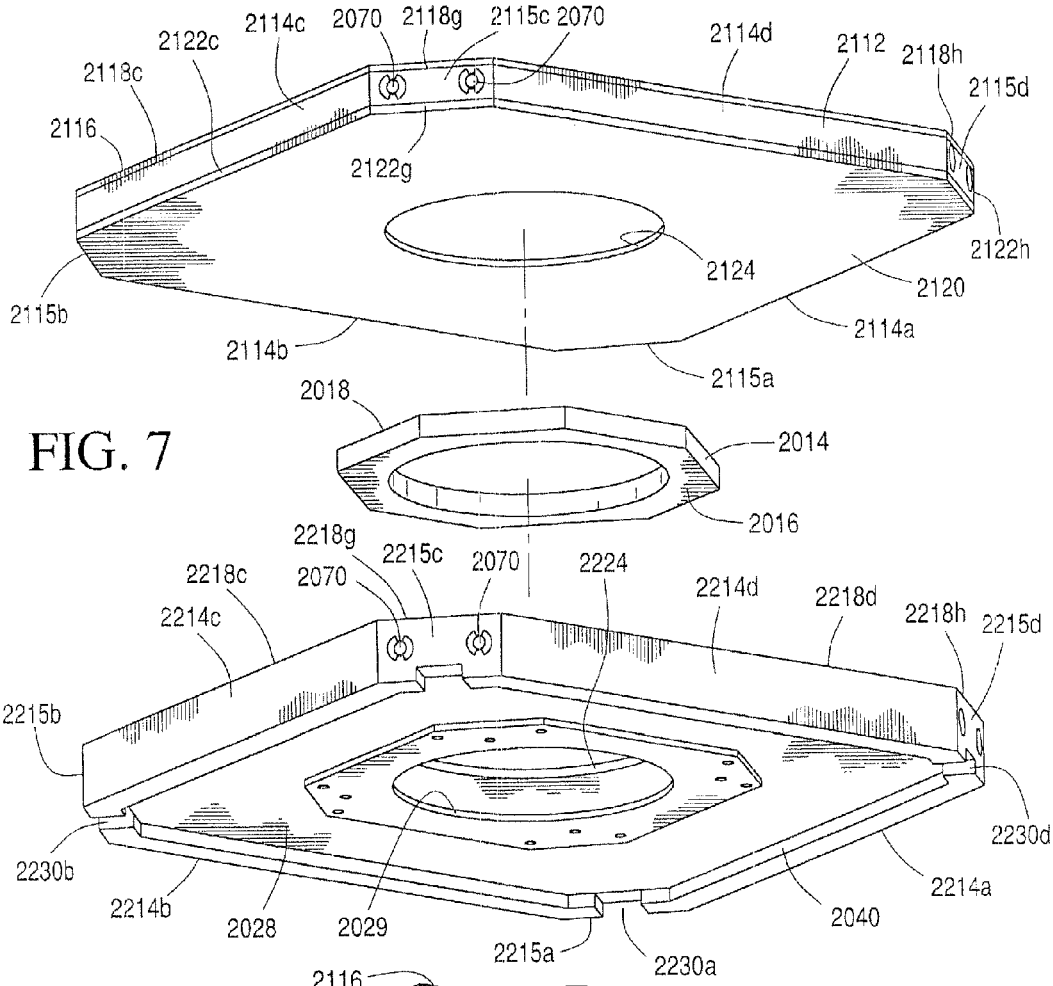
FIG. 7 is an exploded view of the housing for the subwoofer module shown in FIG. 6 (with the driver not shown).

The detailed embodiments of the present invention are disclosed herein. It should be understood, however, that the disclosed embodiments are merely exemplary of the invention, which may be embodied in various forms. Therefore, the details disclosed herein are not to be interpreted as limiting, but merely as a basis for teaching one skilled in the art how to make and/or use the invention.

With reference to FIGS. 1 to 5, a loudspeaker system in the form of a subwoofer module 1010 is disclosed. The subwoofer module 1010 is particularly designed for use within an aircraft, although the subwoofer module 1010 may be used in various other environments without departing from the spirit of the present invention. The present subwoofer module 1010 is particularly designed for horizontal positioning on the floor of an aircraft.

The subwoofer module 1010 includes a substantially square housing 1012 when viewed from above or below). The housing 1012 is preferably manufactured from aluminum. More specifically, the housing 1012 is preferably manufactured from a ¼ inch thick aluminum honeycomb sheet material. While preferred materials are disclosed in accordance with a preferred embodiment of the present invention, it is contemplated other materials may be used without departing from the spirit of the present invention. Regardless of the material used in the construction of the housing 1012, the chosen material should resonate in a manner transmitting sound from the interior of the housing 1012. The mechanism by which the housing 1012 functions as transducer in the transmission of sound is discussed below in greater detail.

The housing 1012 is composed of an upper housing unit 1112 and a lower housing unit 1212. As will be appreciated based upon the following disclosure, the upper housing unit 1112 and the lower housing unit 1212 are substantially hollow structures and are connected by a cylindrical passageway 1014. As shown in the drawings, the cylindrical passageway 1014 is a tubular member with a hollow central section through which air and sound waves may freely move. The cylindrical passageway 1014 connects the upper housing unit 1112 to the lower housing unit 1212 in such a manner to permit the flow of air and sound waves therebetween.

The lower housing unit 1212 generally includes four side walls 1214*a-d* and a cover plate 1216 positioned over the top surface 1218*a-d* of the side walls 1214*a-d*. As will be explained below in greater detail, the lower housing unit 1212 is bisected by a central driver mounting plate 1028. In accordance with a preferred embodiment, the four side walls 1214*a-d* are oriented at a 90 degree angle relative to respective adjacent side walls.

Because of the construction details employed in accordance with the present invention, that is, the multiple member layered on top of each other, the side walls 1218*a-d* are composed of multiple elements layered in a specific manner to define an integral side wall 1218*a-d*. In particular, the peripheral edges 1270 of the cover plate 1216 sit upon a first set of narrow elongated members 1272 aligned with the peripheral edges 1270 of the cover plate, which sit upon, and are aligned with, the peripheral edges 1274 of central driver mounting plate 1028, which ultimately sit upon, and are aligned with, a second set of narrow elongated members 1276. As such, the side walls 12*a-d* are considered to be composed of peripheral edges 1270 of the cover plate 1216 and central driver mounting plate 1028 as well as the first and second sets of the narrow elongated members 1272, 1276.

Similarly, the upper housing unit 1112 includes four side walls 1114*a-d*. An upper cover plate 1116 is positioned over the top surface 1118*a-d* of the side walls 1114*a-d* and a lower cover plate 1120 is positioned over the lower surface 1122*a-d* of the side walls 1114*a-d*. As with the lower housing unit 1212, and because of the construction details required in accordance with such an assembly, the side walls 1114*a-d* are composed of multiple elements layered in a specific manner to define an integral side wall 1114*a-d*. In particular, the peripheral edges 1170 of the upper cover plate 1116 sit upon a third set of narrow elongated members 1172 aligned with the peripheral edge 1170 of the cover plate, which sit upon, and are aligned with, the peripheral edges 1174 of the lower cover plate 1120. As such, the side walls 1114*a-d* are considered to be composed of peripheral edges 1170, 1174 of the upper cover plate 1116 and lower cover plate 4120 as well as the third set of the narrow elongated members 1172.

The cover plate 1216 of the lower housing unit 1212 is provided with a central aperture 1224 and the lower cover plate 1120 of the upper housing unit 1112 is provided with a central aperture 1124 that is in alignment with the central aperture 1224 of the cover plate 1216 of the lower housing unit 1212; that is, a longitudinal axis extending perpendicularly through the center of the central aperture 1224 of the cover plate 1216 of the lower housing unit 1212 is the same as the longitudinal axis extending perpendicularly through the center of the central aperture 1124 of the lower cover plate 1120 of the upper housing unit 1112.

The cylindrical passageway 1014 extends between the upper housing unit 1112 and the lower housing unit 1212 with the central aperture 1124 of the upper housing unit 1112 aligned with the central aperture 1224 of the lower housing unit 1212. That is, the lower edge 1016 of the cylindrical passageway 1014 is secured to the cover plate 1216 of the lower housing unit 1212 adjacent to the central aperture 1224 formed therein and the upper edge 1018 of the cylindrical passageway 1014 is secured to the lower cover plate 1120 of the upper housing unit 1112 adjacent the central aperture 1124 formed therein. In this way, the space defined by the lower housing unit 1212 is in fluid communication with the space defined by the upper housing unit 1112. The upper and lowering housing units 1112, 1214 are further provided with supporting member 1090*a-d* positioned therebetween at various locations about the periphery of the housing 1012.

The upper housing unit 1112 and the lower housing unit 1212 have substantially the same length and width dimensions and, as such, when fully assembled result in a complete housing 1012. In accordance with a preferred embodiment, the side walls 1114*a-d*, 1214*a-d* of the upper housing unit 1112 and the lower housing unit 1212 are oriented such that, when viewed from above or below, the housing 1012 has a square four-sided geometric configuration. The specific configuration of the housing 1012 is critical to proper placement of the housing 1012 within limited and predefined spaces within the aircraft that are available for the mounting of the subwoofer module 1010.

A central driver mounting plate 1028 is secured to the respective side walls 1214*a-d* of the lower housing unit 1212 (in particular, between the first and second sets of narrow elongated members 1272, 1276) and divides the housing 1012 into an upper compartment 1030 and a lower compartment 1032. The central driver mounting plate 1028, therefore, lies in a plane that is substantially parallel to the plane in which the cover plate 1216 of the lower housing unit 1212 lies. The central driver mounting plate 1028 also lies in a plane that is substantially parallel to the plane in which the upper cover plate 1116 and the lower cover plate 1120 of the upper housing unit 1112.

The upper compartment 1030 is defined by the upper surface 1034 of the driver mounting plate 1028, the respective side walls 1214*a-d* of the lower housing unit 1212, the cover plate 1216 of the lower housing unit 1212, and the cylindrical passageway 1014, as well as the space defined by the lower cover plate 1120 of the upper housing unit 1112, the side walls 1114*a-d* of the upper housing unit 1112 and the upper cover plate 1116 of the upper housing unit 1112.

The lower compartment 1032 is defined by the lower surface 1038 of the driver mounting plate 1028 and the respective side walls 1214*a-d* of the lower housing unit 1212, while the bottom 1040 of the housing 1012 (that is, the bottom of the lower housing unit 1214) remains open to be ultimately closed off when the subwoofer module 1010 is mounted to the floor 1042 in the manner discussed below in greater detail.

As will be appreciated based upon the following disclosure, each of the side walls 1214*a-d* of the lower housing unit 1212 is provided with a side wall aperture 1230*a-d* (formed by the spacing of the second set of narrow elongated member 1176). The side wall apertures 1230*a-d* are formed along the respective side walls 1214*a-d* at a position below the central driver mounting plate 1028. In that way, the side wall apertures 1230*a-d* are located between the central mounting plate 1028 and the bottom 1040 of the housing 1012. The side wall apertures 1230*a-d* link the lower compartment 1032 to the external environment surrounding the housing 1012 when the bottom 1040 of the housing 1012 is closed off upon mounting to the floor 1042 as shown in FIG. 20.

A low frequency driver 1024 is mounted to the driver mounting plate 1028 in alignment with the aperture 1029 formed in the driver mounting plate 1028. The low frequency driver 1024 is positioned to fire into the lower compartment 1032 of the housing 1012 with the convex portion 1044 (and magnet 1045) of the low frequency driver 1024 extending into the upper compartment 1030 of the housing 1012.

The housing 1012 is further provided with a wire passage aperture 1070 and mounting bracket apertures 1072 for the attachment of mounting brackets 1074 with connectors 1076, for example, Shurlock connectors. In accordance with a preferred embodiment, the wire passage aperture 1070 is formed in a side wall 1214*a* of the lower housing unit 1212. The mounting bracket apertures 1072 are formed in opposed side wall 1214*a*, 1214*c*; in accordance with a preferred embodiment, along opposed side walls 1214*a*, 1214*c* of the lower housing unit 1212.

In use, the present subwoofer module 1010 is designed for mounting to the floor 1042 beneath an aircraft seat 1048. Mounting is achieved by the provision of mounting brackets 1074 secured to the side walls 1214*a*, 1214*c* as discussed herein and in a manner similar to that disclosed in U.S. patent application Ser. No. 13/106,308, entitled "RECTANGULAR WALL MOUNTED SPEAKER ASSEMBLY," which is incorporated herein by reference. Each of the mounting brackets 1074 is L-shaped with a first leg 1075 adapted for attachment to the side walls 1214*a*, 1214*c* and a second leg 1077 adapted for attachment to the floor 1042, or other support surface, via SHURLOCK fasteners.

As briefly discussed above, the sealed enclosure of the lower compartment 1032 is exposed to the external environment via the side wall apertures 1230*a-d* formed in each of the side walls 1214*a-d* of the lower housing unit 1212 as discussed above. Additional sound is transmitted from the housing 1012 which resonates in conjunction with the low frequency driver 1024.

Mounting the present subwoofer module 1010 in this manner presents further advantages improving the sound generated by the properly mounted subwoofer module 1010. For example, the creation of a partially enclosed-lower compartment 1032, including the respective side wall apertures 1230*a-d* formed in the side walls 1214*a-d* of the lower housing unit 1212, reduces possible excursions ($X_{max}$) of the low frequency driver 1024 by physically damping the movement of the driver cone 1064 with progressively greater pressure on the driver cone 1064. That is, because the driver cone 1064 moves within the confined space defined by the lower compartment 1032, pressure is generated as the driver cone 64 moves closer to the surface of the floor 1042 upon which the subwoofer module 1010 is mounted. The pressure increases in such a way that the generated pressure prevents further movement of the driver cone 1064.

The reduction and control of the possible excursion of the driver cone 1064 eliminate cone chirp which results when the driver cone 1064 moves beyond $X_{max}$. With this in mind, the side wall apertures 1230*a-d* and the relative position of the low frequency driver 1024 with respect to the floor 1042 may be tuned to enhance the efficiency of the present subwoofer design.

In addition, the controlled excursion of the driver cone 1064 enhances the sound resonating from the housing 1012 itself to produce a full low frequency sound from an enclosure substantially smaller and lighter than woofers found in the prior art.

The resulting subwoofer module 1010 is wired in a conventional manner, which those skilled in the art will readily appreciate. As such, variations in wiring are contemplated in accordance with the spirit of the present invention.

With reference to FIGS. 6 to 9, an alternate embodiment of the present subwoofer module is disclosed. The subwoofer module 2010 includes a substantially octagonal housing 2012 (when viewed from above or below). As with the prior embodiment, the housing 2012 is preferably manufactured from aluminum. More specifically, the housing 2012 is preferably manufactured from a ¼ inch thick aluminum honeycomb sheet material.

The housing 2012 is composed of an upper housing unit 2112 and a lower housing unit 2212. As will be appreciated based upon the following disclosure, the upper housing unit 2112 and the lower housing unit 2212 are substantially hollow structures and are connected by a cylindrical passageway 2014. The cylindrical passageway 2014 connects the upper housing unit 2112 to the lower housing unit 2212 in such a manner to permit the flow of air and sound waves therebetween.

The lower housing unit 2212 includes eight lateral side walls, that is, four lateral side walls 2214*a-d* and four short corner side walls 2215*a-d*. The lower housing unit 2212 also includes a cover plate 2216 positioned over the top surfaces 2218*a-h* of the side walls 2214*a-d*, 2215*a-d*. The four short corner side walls 2215*a-d* are positioned between, and connected to, respective lateral side walls 2214*a-d*. The corner side walls 2215*a-d* are oriented at a 45 degree angle relative to the respective lateral side walls 2214*a-d*. As such, the lower housing unit 2212 has an eight-sided geometric configuration, with a generally octagonal configuration as a result of the side walls 2214*a-d*, 2215*a-d*. The specific configuration of the lower housing unit 2212 is critical to proper placement of the lower housing unit 2212 within limited and predefined spaces within the aircraft that are available for the mounting of the subwoofer module 2010. As will be appreciated based upon the foregoing disclosure, the sidewalls are constructed in a layered manner.

Similarly, the upper housing unit 2112 includes eight lateral side walls, that is, four lateral side walls 2114*a-d* and four short corner side walls 2115*a-d*. The lower housing unit 2212 also includes an upper cover plate 2116 positioned over the top surface 2118*a-h* of the side walls 2114*a-d*, 2115*a-d* and lower cover plate 2120 positioned over the bottom surface 212*a-h* of the side walls 2114*a-d*, 2115*a-d*. The four short corner side walls 2115*a-d* are positioned between, and connected to, respective lateral side walls 2114*a-d*. The corner side walls 2115*a-d* are oriented at a 45 degree angle relative to the respective lateral side walls 2114*a-d*. As such, the upper housing unit 2112 has an eight-sided geometric configuration, with a generally octagonal configuration as a result of the side walls 2114*a-d*, 2115*a-d*. As will be appreciated based upon the foregoing disclosure, the sidewalls are constructed in a layered manner.

The cover plate 2216 of the lower housing unit 2212 is provided with a central aperture 2224 and the lower cover plate 2120 of the upper housing unit 2112 is provided with a central aperture 2124 that is in alignment with the central aperture 2224 of the cover plate 2216 of the lower housing unit 2212; that is, a longitudinal axis extending perpendicularly through the center of the central aperture 2224 of the cover plate 2218 of the lower housing unit 2212 is the same as the longitudinal axis extending perpendicularly through the center of the central aperture 2124 of the lower cover plate 2120 of the upper housing unit 2112.

The cylindrical passageway 2014 extends between the upper housing unit 2112 and the lower housing unit 2212 with the central aperture 2124 of the upper housing unit 2112 aligned with the central aperture 2224 of the lower housing unit 2212. That is, the lower edge 2016 of the cylindrical passageway 2014 is secured to the cover plate 2216 of the lower housing unit 2212 adjacent to the central aperture 2224 formed therein and the upper edge 2018 of the cylindrical passageway 2014 is secured to the lower cover plate 2120 of the upper housing unit 2112 adjacent the central aperture 2124 formed therein. In this way, the space defined by the lower housing unit 2212 is in fluid communication with the space defined by the upper housing unit 2112.

The upper housing unit 2112 and the lower housing unit 2212 have substantially the same length and width dimensions and, as such, when fully assembled result in a complete housing 2012. In accordance with a preferred embodiment, the side walls 2114*a-d*, 2115*a-d*, 2214*a-d*, 2215*a-d* of the upper housing unit 2112 and the lower housing unit 2212 are oriented such that, when viewed from above or below, the housing 2012 has an eight-sided geometric configuration. The specific configuration of the housing 2012 is critical to proper placement of the housing 2012 within limited and predefined spaces within the aircraft that are available for the mounting of the subwoofer module 2010.

A central driver mounting plate 2028 is secured to the respective lateral side walls 2214*a-d* of the lower housing unit 2212 and divides the housing 2012 into an upper compartment 2030 and a lower compartment 2032. The central driver mounting plate 2028, therefore, lies in a plane that is substantially parallel to the plane in which the cover plate 2216 of the lower housing unit 2212 lies. The central driver mounting plate 2028 also lies in a plane that is substantially parallel to the plane in which the upper cover plate 2116 and the lower cover plate 2120 of the upper housing unit 2112.

The upper compartment 2030 is defined by the upper surface 2034 of the driver mounting plate 2028, the respective side walls 2214*a-d*, 2215*a-d* of the lower housing unit 2212, the cover plate 2216 of the lower housing unit 2212, and the cylindrical passageway 2014, as well as the space defined by the lower cover plate 2120 of the upper housing unit 2112, the side walls 2114*a-d*, 2115*a-d* of the upper housing unit 2112 and the upper cover plate 2116 of the upper housing unit 2112.

The lower compartment 2032 is defined by the lower surface 2038 of the driver mounting plate 2028 and the respective side walls 2214*a-d*, 2215*a-d* of the lower housing unit 2212, while the bottom 2040 of the housing 2012 (that is, the bottom of the lower housing unit 2212) remains open to be ultimately closed off when the subwoofer module 2010 is mounted to the floor 2042 in the manner discussed below in greater detail.

As will be appreciated based upon the following disclosure, each of the corner side walls 2215*a-d* of the lower housing unit 2212 is provided with a side wall aperture 2230*a-d*. The side wall apertures 2230*a-d* are formed along the respective corner side walls 2215*a-d* at a position below the central driver mounting plate 2028. In that way, the side wall apertures 2230*a-d* are located between the central driver mounting plate 2028 and the bottom 2040 of the housing 2012. The side wall apertures 2230*a-d* link the lower compartment 2032 to the external environment surrounding the housing 2012 when the bottom 2040 of the housing 2012 is closed off upon mounting to the floor 2042 as shown in FIG. 23.

A low frequency driver 2024 is mounted to the driver mounting plate 2028 in alignment with the aperture 2029 formed in the driver mounting plate 2028. The low frequency driver 2024 is positioned to fire into the lower compartment 2032 of the housing 2012 with the convex portion 2044 (and magnet 2045) of the low frequency driver 2024 extending into the upper compartment 2030 of the housing 2012.

The housing 2012 is further provided with a wire passage aperture 2070 and mounting bracket apertures 2072 for the attachment of mounting brackets 2074 with connectors 2080, for example, screws. The mounting brackets 2074 are preferably secured to the floor 2042 with Sherlock connectors 2082. In accordance with a preferred embodiment, the wire passage aperture 2070 is formed in one of the corner side walls of the lower housing unit 2212. The mounting bracket apertures 2072 are formed each of the corner side walls of the upper and lower housing units; in accordance with a preferred embodiment, two mounting bracket apertures 2072 are formed in each of the corner side walls 2115*a-d*, 2215*a-d* of the upper and lower housing unit 2112, 2212, wherein screws are used in attaching the mounting brackets 2074 to the corner side walls 2115*a-d*, 2215*a-d*.

Figure 9:
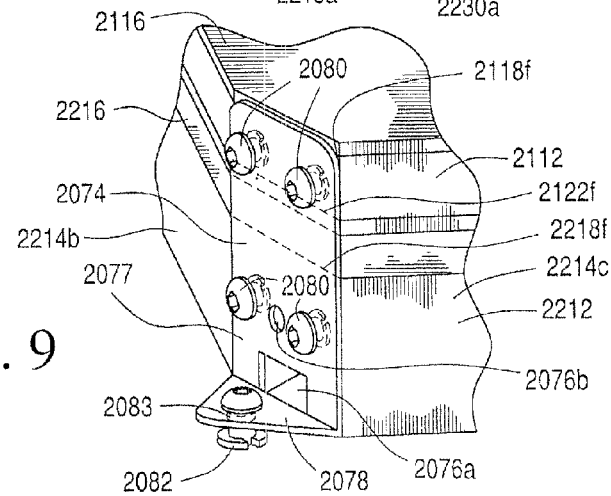
FIG. 9 is a detailed perspective view showing the mounting structure used in accordance with the subwoofer module shown in FIG. 6.

With the side wall apertures 2230*a-d* being formed in the corner side walls 2215*a-d* of the lower housing unit 2212 and the mounting bracket apertures 2072 being formed in the same corner side walls 2115*a-d*, 2215*a-d* of the upper and lower housing units 2112, 2212 it is necessary that the mounting brackets 2074 be specially designed to provide for attachment without covering the side wall apertures 2230*a-d*. Each of the mounting brackets 2074 is identical and only one will be described herein. Referring to FIG. 9, the mounting bracket 2074 is substantially L-shaped and includes a first leg 2077 and a second leg 2078 oriented at a 90 degree angle relative to each other. The first leg 2077 is shaped and dimensioned for direct attachment to the corner side walls 2115*a-d*, 2215*a-d* via screws 2080 and the second leg 2078 is shaped and dimensioned for attachment to the floor 2042, or other support surface, via SHURLOCK fasteners 2082 which extend through holes 2083 formed in the second leg 2078. As discussed above, each of the corner side walls 2215*a-d* includes a side wall aperture 2230*a-d* and one of the corner side walls 2215*a-d* includes a wire passage aperture 2070. The first leg 2077 is, therefore, constructed with first and second mounting bracket apertures 2076*a*, 2076*b* shaped and dimensioned for alignment with the side wall and wire passage apertures 2230*a-d*, 2070 formed in the corner side walls 2215*a-d*.

As discussed above with reference to the prior embodiment, mounting the present subwoofer module 2010 in the manner described above presents further advantages improving the sound generated by the properly mounted subwoofer module 2010.

By using the floor of the aircraft to form a wall of the lower compartment of the housing, substantial weight savings are realized. In accordance with the preferred embodiment of the present invention, use of the floor in completing the lower compartment results in a substantial weight savings. While a simple plate in a housing may appear to represent only a small amount of weight, any weight reduction within an aircraft is considered to be a substantial benefit, especially as more than one unit per aircraft is necessary.

The resulting subwoofer module is wired in a conventional manner, which those skilled in the art will readily appreciate. As such, variations in wiring are contemplated in accordance with the spirit of the present invention.

It should be appreciated that the concepts surrounding the present invention may be applied in various applications without departing from the spirit of the present invention. As such, the dimensions of the subwoofer module may be varied to suit specific applications in accordance with the spirit of the present invention.

In practice, multiple subwoofers are commonly mounted within an aircraft. The number of subwoofers employed is determined by the size of the aircraft and the needs of the aircraft owners. Those of ordinary skill in the art will certainly appreciate the need for specific positioning of the subwoofers within the aircraft to optimize the generated sound.

While the preferred embodiments have been shown and described, it will be understood that there is no intent to limit the invention by such disclosure, but rather, it is intended to cover all modifications and alternate constructions falling within the spirit and scope of the invention.

The invention claimed is:

1. A loudspeaker system, comprising:

a housing including a upper housing unit that is hollow, a lower housing unit that is hollow, and a passageway that is with a hollow central section through which air and sound waves may freely move, the passageway connecting the upper housing unit and the lower housing unit such that the upper housing unit and the lower housing unit are in fluid communication;

a driver mounting plate divides the housing into an upper compartment and a lower compartment, wherein the upper compartment is defined by an upper surface of the driver mounting plate, the passageway and the upper housing unit, and the lower compartment is defined by a lower surface of the driver mounting plate and a side wall of the lower housing unit, a bottom of the housing remaining open to be ultimately closed off when the loudspeaker system is mounted to a supporting surface;

the lower housing unit including a side wall aperture linking the lower compartment to an external environment surrounding the housing;

a driver mounted to the driver mounting plate, the driver being positioned to fire into the lower compartment of the housing.

2. The loudspeaker system according to claim 1, wherein the driver is a low frequency driver.

3. The loudspeaker system according to claim 1, wherein the housing is made of aluminum honeycomb sheet material that resonates in a manner transmitting sound from an interior of the housing.

4. The loudspeaker system according to claim 1, wherein the housing is octagonal shaped.

5. The loudspeaker system according to claim 1, wherein the lower housing unit includes side walls and a cover plate positioned over a top surface of the side walls, and the upper housing unit includes side walls, an upper cover plate positioned over a top surface of the side walls of the upper housing member and a lower cover plate positioned over a lower surface of the side walls of the upper housing member.

6. The loudspeaker system according to claim 5, wherein the central driver mounting plate is secured to the side walls of the lower housing unit.

7. The loudspeaker system according to claim 6, wherein the upper compartment is defined by the upper surface of the driver mounting plate, the side walls of the lower housing unit, the cover plate of the lower housing unit, the passageway, the lower cover plate of the upper housing unit, the side walls of the upper housing unit and the upper cover plate of the upper housing unit.

* * * * *